United States Patent [19]

Moore

[11] Patent Number: 4,918,433

[45] Date of Patent: Apr. 17, 1990

[54] WATER IMMERSION ALARM BELT

[76] Inventor: Robert L. Moore, Box 67 Moorewood Ave., Merrittstown, Pa. 15463

[21] Appl. No.: 410,409

[22] Filed: Sep. 21, 1989

[51] Int. Cl.[4] ..... G08B 23/00

[52] U.S. Cl. ..... 340/573; 200/61.05

[58] Field of Search ..... 340/573, 604, 539; 200/61.05, 61.04, DIG. 2; 441/80, 88, 106, 108, 123, 6, 11, 12, 89, 81, 113; 114/343, 345

[56] References Cited

U.S. PATENT DOCUMENTS

| | | | |
|---|---|---|---|
| 3,122,736 | 2/1964 | Heber | 340/604 |
| 3,354,395 | 11/1967 | Merck et al. | 342/385 |
| 3,810,146 | 5/1974 | Lieb | 340/541 |
| 4,079,364 | 3/1978 | Antenore | 340/573 |
| 4,549,169 | 10/1985 | Moura et al. | 340/573 |
| 4,673,936 | 6/1987 | Kotoh | 342/51 |
| 4,714,914 | 12/1987 | Boe | 340/573 |

*Primary Examiner*—Joseph A. Orsino
*Assistant Examiner*—Geoff Sutcliffe
*Attorney, Agent, or Firm*—Fleit, Jacobson, Cohn, Price, Holman & Stern

[57] ABSTRACT

A belt is provided for horizontally encircling and support from a human body portion and the belt is constructed of water impervious material and includes relatively insulated longitudinally extending internal first and second relatively insulated conductors. First and second sets of electrical contact members are provided and are electrically connected to the first and second conductors, respectively, and the contact members include portions thereof exposed relative to the outer side of the belt. The outer side of the belt includes downwardly opening housing portions of water impervious material disposed over the exposed portions of the contact members and each housing portion includes a vent opening therein for venting trapped air therefrom. The conductors may be electrically connected in a powered circuit to be closed by water bridging at least one contact member of one set of contact members and one contact member of other set of contact members, which circuit is to be operatively associated with an alarm signal generator.

11 Claims, 1 Drawing Sheet

WATER IMMERSION ALARM BELT

BACKGROUND OF THE INVENTION

FIELD OF THE INVENTION

This invention relates to a waist encircling belt to be worn by non-swimmers and includes a pair of interior, relatively electrically insulated electrical conductors which are in turn connected to a belt attached signal transmitter and power supply. The belt is constructed of water impervious material and houses two sets of electrical contacts electrically connected to longitudinally spaced portions of the conductors and including contact portions which project through the belt from the interior thereof.

Each contact portion exposed to the exterior of the belt is enclosed within a outwardly opening housing including an upper vent port such that rain water or perspiration contacting the outer surface of the belt will not be operative to electrically bridge the exposed contact portions. However, should the wearer of the belt fall into a body of water the exposed electrical contact portions will be bridged in order to complete the circuit to the signal transmitter.

Operatively associated with the signal transmitter is a signal receiver and the receiver, upon receiving a signal from the transmitter, is operative to actuate an alarm remote from the belt.

DESCRIPTION OF RELATED ART

Various different forms of water safety alarm systems including some of the general structural and operational features of the instant invention are disclosed in U.S. Pat. Nos. 3,354,495, 3,810,146, 4,079,364, 4,673,936, and 4,714,914. However, these previously known forms of alarms are not suitable for use by children in backyard areas since many of these alarms could be actuated by sprinkler water, rain water or perspiration, the alarm belt of the instant invention being specifically designed to prevent actuation thereof due to rain, sprinkler water or perspiration while still being reliably actuatable in the event the wearer falls into a body of water.

SUMMARY OF THE INVENTION

Although many alarm devices heretofore have been designed for generating an alarm as a result of open contacts in an electrical circuit being electrically bridged by water, a need exist for an alarm system of the same general type, but which will not be actuated as a result of falling sprinkler water and rain or perspiration.

The alarm belt of the instant invention is specially constructed with shielded contacts to be electrically bridged by water and the shielding operatively associated with the electrical contacts is such to prevent bridging of the contacts in substantially all instances, except when the wearer of the belt falls into a body water.

The main object of this invention is to provide an alarm system which may be reliably utilized by parents in conjunction with children in backyards or other areas adjacent a swimming pool.

Another object of this invention is to provide an alarm system which will not render a false alarm as a result of falling rain or sprinkler water and/or perspiration.

Another very important object of this invention is to provide an alarm system which may be used by persons of all ages and in many different environments adjacent any body of water in which a person might drown.

A final object of this invention to be specifically enumerated herein is to provide an alarm system in accordance with the preceding objects and which will conform to conventional forms of manufacture, be of simple construction and dependable in operation so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part of hereof, wherein like numerals refer to like parts throughout.

DESCRIPTION OF THE PREFERRED EMBODIMENT

Figure 1:
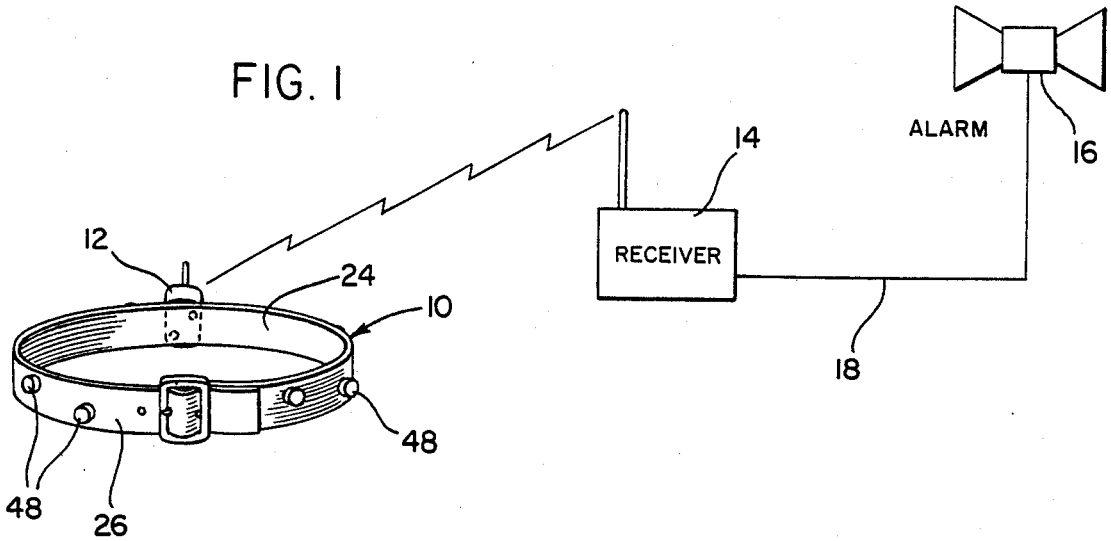
FIG. 1 is a perspective view of the alarm belt of the instant invention and including a schematic representation of an associated receiver and alarm.
Figure 2:
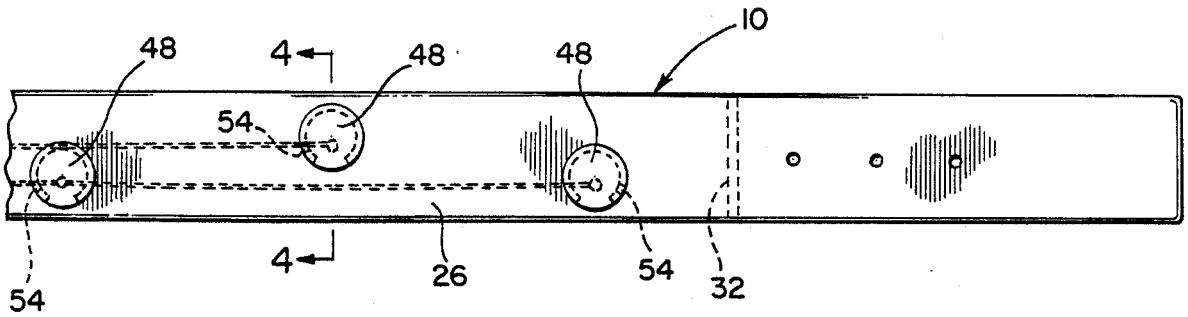
FIG. 2 is an enlarged fragmentary side elevational view of the outer side of one end of the belt.
Figure 3:
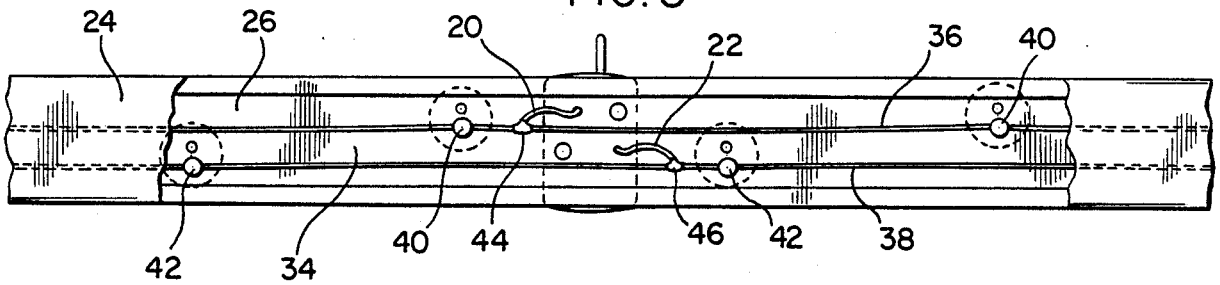
FIG. 3 is an enlarged fragmentary elevational view of the mid-length portion of the belt from which the signal transmitter is supported and as seen from the inside of the belt with the near side panel of the belt broken away.
Figure 4:
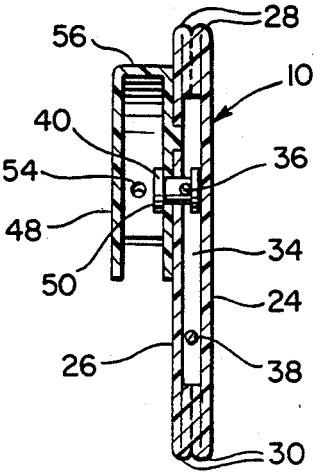
FIG. 4 is an enlarge vertical sectional view taken substantially upon the plane indicated by the section line 4–4 of FIG. 2.

Referring now more specifically to the drawings the numeral 10 generally designates the alarm belt of the instant invention, the belt 10 supporting an antenna equipped, battery powered transmitter 12 therefrom of any suitable type and operatively associated with a remote antenna equipped signal receiver 14 and an electrically actuatable alarm signal generator 16 with which the receiver is electrically connected as at 18.

The transmitter 10 is of sufficient power to transmit a signal to be received by the receiver 14, even though the signal might be generated from a water depth of 10 feet at the bottom of a swimming pool.

The specific structure and operation of the transmitter, receiver and alarm signal generator may be conventional with the exception that the transmitter will have a low voltage, battery powered actuating circuit operatively associated therewith including a pair of spaced conductors 20 and 22 which must be electrically bridged to initiate operation of the transmitter 12.

The belt 10 includes inner and outer layers or plies 24 and 26 each including an upper margin 28 and a lower margin 30. The upper margins 28 are sealingly secured together in any convenient manner and the lower margins 30 similarly joined. Still further, each end portion of the belt 10 includes a vertical seal zone 32 extending between the upper and lower margins of the belt 10, thereby defining a fully closed and water tight chamber 34 between the layers or plies 24 and 26.

A pair of upper and lower conductors 36 and 38 extend longitudinally of the chamber 34 and have longitudinally spaced portions thereof supported from upper and lower electrical contact members 40 and 42 sealingly secured through the outer layer 24. The longitudinally portions of the conductors 36 and 38 with which the electrical contact members 40 and 42 are operatively associated are supported from the electrical contact members 40 and 42, thereby maintaining the conductors 36 and 38 out of electrical contact with each other. The conductors 20 and 22 are electrically connected to the conductors 36 and 38 as at 44 and 46 and the conductors 36 and 38 thereby form extensions of the electrical conductors 20 and 22.

The outer layer or ply 26 of the belt 10 has a plurality of downwardly opening housings 48 supported therefrom and each of the housings 48 encloses therein the exposed portion 50 of a corresponding contact member 40, the housings 48 including vent openings 54 formed therein.

The housings 48 are generally cylindrical in plan shape and are secured to the outer layer or ply 26 in any convenient manner. Furthermore, generally mid-height portions of the outer cylindrical walls 56 of the housings 48 have the vent openings 54 formed therein. Although the vent openings 54 could be formed in upper portions of the wall 56, it is preferable that they be formed in portions of the walls 56 spaced slightly below the vertical centers of the housings 48. In this manner, if rain water, sprinkler water or perspiration falls down on the upper portions of the walls 56 of the housings 48, such water or perspiration may not flow into the housings 48 for contact with the exposed portions 50 of the electrical contact members 40. However, should the wearer of the belt 10 fall into a body of water the vent openings 54 will allow air entrapped within the housing 48 to be vented therefrom, the vent openings 50 in adjacent housings 48 spaced along the belt 10 being formed in opposite side portions of the wall 56 in order to insure proper venting of air entrap within the housings 48 therefrom in the event the belt 10 becomes submerged.

Of course, when the belt 10 becomes submerged in a body of water, the electrical contact members 40, 42 electrically connected to the conductors 36 and 38 will be contacted by the water and the latter will electrically bridge the contact members 40, 42 and thus the conductors 36 and 38 in order to actuate the transmitter 12. Upon actuation of the transmitter 12, a radio signal is generated by the transmitter and received by the receiver 14. Upon the receiver 14 receiving a signal from the transmitter 12, the alarm signal generator 16 is automatically actuated by the electrical connection 18 between the receiver 14 and the alarm signal generator 16.

By enclosing the electrical contact members 14 within the housings 48, falling rain water or sprinkler water may not contact the exposed portions 50 of the electrical contact members 40. Therefore, sprinkler water and rain water will not be operative to actuate the alarm signal generator 16. Furthermore, perspiration will be excluded from contacting the exposed portions 50. However, if the wearer of the belt 10 falls into a body of water the conductors 36 and 38 will be electrically bridged in order to actuate the transmitter 12, and in turn the alarm signal generator 16.

Figure 5:
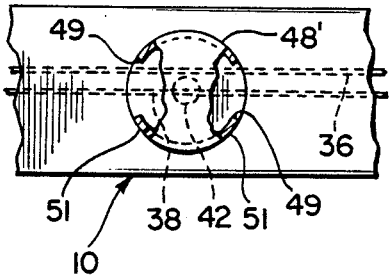
FIG. 5 is an enlarged fragmentary outside elevational view of the mid-length portion of the belt illustrating a modified form of contact member enclosing housing and with the outer portion of the housing broken away and the side walls thereof illustrated in vertical section.

Referring now more specifically to FIG. 5, a modified form of housing is referred to by the reference numeral 48'. The housing 48' is substantially identical to the housings 48, except that opposite side openings 49 are formed in the upstanding side walls 51 of the housing 48', the openings 49 extending above and below the corresponding conductor 38. Of course, the housing 48' illustrated in FIG. 5 is adjacent the lower margin of the belt 10 and corresponding housings (not shown) operatively associated with the conductor 36 are adjacent the upper margin of the belt 10.

However, the housings 48' are still operative to shield the associated contact members 42 against contact therewith by falling rain water or sprinkler water when the belt 10 is being worn by a user. Of course, if a major portion of the belt 10 equipped with the housings 48' is submerged in a body of water, certain of the contact members 40 and 42 will be electrically bridged by the water to thus actuate the alarm 16.

The foregoing is considered as illustrative only of the principles of the invention. Further, since numerous modifications and changes will readily occur to those skilled in art, it is not desired to limit the invention to the exact construction and operation shown and described, and accordingly, all suitable modifications and equivalents may be resorted, falling within the scope of the invention.

What is claimed as new is as follows:

1. A horizontally elongated water immersion alarm belt to be used in conjunction with an electrically actuatable, portable signal generator supported therefrom and a remote signal receiver operatively associated with an alarm for actuation thereof responsive to said signal receiver receiving a predetermined signal from said signal generator and wherein said signal generator includes a pair of electrical conductors serially connected in an electrical supply circuit for said signal generator electrically connected to a suitable source of electrical potential for actuation of said signal generator, said belt including inner and outer layers and upper and lower margins and being adapted to horizontally encircle and be secured about a human body portion, first and second elongated, relatively electrically insulated conductors extending longitudinally of said belt between said layers and adapted to have said pair of electrical conductors connected thereto, first and second sets of electrically conductive contact members mounted from and extending through one of said layers with the contact members of each set of contact members being spaced longitudinally of said belt, said first and second contact members being electrically connected to said first and second conductors, respectively, said one layer including first and second sets of a plurality of housing portions constructed of water impervious material and disposed on the side of said one layer remote from the other layer and within which portions of said first and second contact members are exposed for contact by an electrically conductive liquid within said sets of housing portions, said housing portions opening at least partially downwardly toward said lower margin and each housing portion defining an air vent opening therein at an elevation spaced above the lower most extremity of the corresponding exposed contact member portion.

2. The alarm belt of claim 1 wherein said layers are constructed of water impervious material and are sealed relative to each other along said upper and lower margins of said belt above and below said first and second relatively electrically insulated conductors.

3. The alarm belt of claim 2 wherein said housing portions are generally circular in elevational shape and said contact members are disposed below centered positions relative to said housing portions.

4. The alarm belt of claim 3 wherein said vent openings each are disposed below a horizontal plane containing the vertical centers of the corresponding set of housing portions.

5. The alarm belt of claim 1 wherein said sets of contact members are vertically spaced apart, said sets of housing portions being generally vertically centered in vertically spaced upper and lower horizontal planes, said first and second conductors being vertically spaced apart with the electrically connections of the upper and lower conductors with the upper and lower sets of contact members serving to support and maintain the upper and lower conductors vertically spaced apart.

6. The alarm belt of claim 5 wherein said layers are constructed of water impervious material and are sealed relative to each other along said upper and lower margins of said belt above and below said first and second relatively electrically insulated conductors.

7. The alarm belt of claim 6 wherein said housing portions are generally circular in elevational shape and said contact members are disposed below centered positions relative to said housing portions.

8. The alarm belt of claim 7 wherein said vent openings each are disposed below a horizontal plane containing the vertical centers of the corresponding set of housing portions.

9. A horizontally elongated water immersion alarm belt to be used in conjunction with an electrically actuatable, portable signal generator supported therefrom and a remote signal receiver operatively associated with an alarm for actuation thereof responsive to said signal receiver receiving a predetermined signal from said signal generator and wherein said signal generator includes a pair of electrical conductors serially connected in an electrical supply circuit for said signal generator electrically connected to a suitable source of electrical potential for actuation of said signal generator, said belt including inner and outer layers and upper and lower margins and being adapted to horizontally encircle and be secured about a human body portion, first and second elongated, relatively electrically insulated conductors extending longitudinally of said belt between said layers and adapted to have said pair of electrical conductors connected thereto, first and second sets of electrically conductive contact members mounted from and extending through one of said layers with the contact members of each set of contact members being spaced longitudinally of said belt, said first and second contact members being electrically connected to said first and second conductors, respectively, said one layer including first and second sets of a plurality of housing portions constructed of water impervious material and disposed on the side of said one layer remote from the other layer and within which portions of said first and second contact members are exposed for contact by an electrically conductive liquid within said sets of housing portions, said housing portions defining openings therein communicating the exteriors of said housing portions with the interiors thereof and inwardly of which openings said contact member portions are at least substantially shielded against contact therewith by incidental water spray and/or perspiration or rain water flowing downward over said belt and housing portions from thereabove while still enabling water ingress through said openings into said housing portions in the event at least a major portion of said belt is submerged in a body of water, said housing portions also defining air vent means for venting air from the interiors of said housings to enable water in which at least a major portion of said belt is submerged to rise in said housing portions sufficient to contact said contact member portions.

10. The alarm belt of claim 9 wherein said openings are formed in opposite side walls of said housing portions and extend slightly above and below horizontal planes containing said belt and the upper and lower portions, respectively, of said contact member portions.

11. The alarm belt of claim 9 wherein said openings are formed in bottom wall portions of said housings and the upper extremities of said openings lie in horizontal planes containing said belt and spaced below said contact member portions, said vent means including a small diameter vent opening formed in a vertically extending side wall of each of said housings with said vent opening disposed in a horizontal plane containing said belt and also containing said contact member portions.

* * * * *